US007142088B2

(12) United States Patent
Tanaka

(10) Patent No.: US 7,142,088 B2
(45) **Date of Patent: *Nov. 28, 2006**

(54) ALLOY TYPE THERMAL FUSE AND MATERIAL FOR A THERMAL FUSE ELEMENT

(75) Inventor: Yoshiaki Tanaka, Osaka (JP)

(73) Assignee: Uchibashi Estec Co., Ltd., Osaka (JP)

( * ) Notice: Subject to any disclaimer, the term of this patent is extended or adjusted under 35 U.S.C. 154(b) by 43 days.

This patent is subject to a terminal disclaimer.

(21) Appl. No.: 10/656,580

(22) Filed: Sep. 4, 2003

(65) Prior Publication Data

US 2004/0100355 A1 May 27, 2004

(30) Foreign Application Priority Data

Nov. 26, 2002 (JP) ..... 2002-342068

(51) Int. Cl.
*H01H 85/06* (2006.01)
*H01H 85/11* (2006.01)
*H01H 85/55* (2006.01)

(52) U.S. Cl. ..... 337/290; 337/160; 337/181; 337/296

(58) Field of Classification Search ..... 337/152, 337/159, 160, 181, 180, 290, 296, 158; 29/623; 148/400, 442; 420/559, 561, 562, 577
See application file for complete search history.

(56) References Cited

U.S. PATENT DOCUMENTS 2,703,352 A * 3/1955 Kozacka ..... 337/163
4,216,457 A * 8/1980 Panaro ..... 337/160
4,367,451 A * 1/1983 Panaro ..... 337/160
5,130,689 A * 7/1992 Raykhtsaum et al. ..... 337/296
6,064,293 A * 5/2000 Jungst et al. ..... 337/290
6,556,122 B1 * 4/2003 Izaki et al. ..... 337/405
2002/0113685 A1 * 8/2002 Izaki et al. ..... 337/405
2004/0100355 A1 * 5/2004 Tanaka ..... 337/404

FOREIGN PATENT DOCUMENTS

| | | | |
|---|---|---|---|
| EP | 1 343 187 A2 | | 9/2003 |
| JP | 56-114237 A | | 9/1981 |
| JP | 59-8229 A | | 1/1984 |
| JP | 3236130 A | | 10/1991 |
| JP | 6325670 A | | 11/1994 |
| JP | 2001073050 A | * | 3/2001 |
| JP | 2001-266724 A | | 9/2001 |
| JP | 2001266723 A | | 9/2001 |
| JP | 2001266724 A | | 9/2001 |
| JP | 2001291459 A | | 10/2001 |
| JP | 2001325867 A | | 11/2001 |
| JP | 2003-034831 | | 2/2003 |

* cited by examiner

*Primary Examiner*—Anatoly Vortman
(74) *Attorney, Agent, or Firm*—Akin Gump Strauss Hauer & Feld, LLP

(57) ABSTRACT

An alloy type thermal fuse is provided in which a ternary Sn—In—Bi alloy is used, excellent overload characteristic and dielectric breakdown characteristic are attained, the insulation stability after an operation can be sufficiently assured, and a fuse element can be easily thinned. A fuse element having an alloy composition in which Sn is larger than 25% and 44% or smaller, Bi is 1% or larger and smaller than 20%, and In is larger than 55% and 74% or smaller is used.

58 Claims, 6 Drawing Sheets

(A)

(B)

ALLOY TYPE THERMAL FUSE AND MATERIAL FOR A THERMAL FUSE ELEMENT

BACKGROUND OF THE INVENTION

1. Field of the Invention

The present invention relates to a material for a Bi—In—Sn thermal fuse element, and also to an alloy type thermal fuse.

An alloy type thermal fuse is widely used as a thermo-protector for an electrical appliance or a circuit element, for example, a semiconductor device, a capacitor, or a resistor.

Such an alloy type thermal fuse has a configuration in which an alloy of a predetermined melting point is used as a fuse element, the fuse element is bonded between a pair of lead conductors, a flux is applied to the fuse element, and the flux-applied fuse element is sealed by an insulator.

The alloy type thermal fuse has the following operation mechanism.

The alloy type thermal fuse is disposed so as to thermally contact an electrical appliance or a circuit element which is to be protected. When the electrical appliance or the circuit element is caused to generate heat by any abnormality, the fuse element alloy of the thermal fuse is melted by the generated heat, and the molten alloy is divided and spheroidized because of the wettability with respect to the lead conductors or electrodes under the coexistence with the activated flux that has already melted. The power supply is finally interrupted as a result of advancement of the spheroid division. The temperature of the appliance is lowered by the power supply interruption, and the divided molten alloys are solidified, whereby the non-return cut-off operation is completed.

2. Description of the Prior Art

Conventionally, a technique in which an alloy composition having a narrow solid-liquid coexisting region between the solidus and liquidus temperatures, and ideally a eutectic composition is used as such a fuse element is usually employed, so that the fuse element is fused off at approximately the liquidus temperature (in a eutectic composition, the solidus temperature is equal to the liquidus temperature). In a fuse element having an alloy composition in which there is a solid-liquid coexisting region, namely, there is the possibility that the fuse element is fused off at an uncertain temperature in the solid-liquid coexisting region. When an alloy composition has a wide solid-liquid coexisting region, the uncertain temperature width in which a fuse element is fused off in the solid-liquid coexisting region becomes large, and the operating temperature is largely dispersed. In order to reduce the dispersion, therefore, the technique in which an alloy composition having a narrow solid-liquid coexisting region, and ideally a eutectic composition is used is usually employed.

Because of increased awareness of environment conservation, the trend to prohibit the use of materials harmful to a living body is recently growing as a requirement on an alloy type thermal fuse. Also an element for such a thermal fuse is requested not to contain a harmful material.

As an alloy composition for such a thermal fuse element, known is a Bi—In—Sn system. Conventionally, known are alloy compositions such as that of 47 to 49% Sn, 51 to 53% In, and the balance Bi (Japanese Patent Application Laying-Open No. 56-114237), that of 42 to 44% Sn, 51 to 53% In, and 4 to 6% Bi (Japanese Patent Application Laying-Open No. 59-8229), that of 44 to 48% Sn, 48 to 52% In, and 2 to 6% Bi (Japanese Patent Application Laying-Open No. 3-236130), that of 0.3 to 1.5% Sn, 51 to 54% In, and the balance Bi (Japanese Patent Application Laying-Open No. 6-325670), that of 33 to 43% Sn, 0.5 to 10% In, the balance Bi (Japanese Patent Application Laying-Open No. 2001-266723), that of 40 to 46% Sn, 7 to 12% Bi, the balance In (Japanese Patent Application Laying-Open No. 2001-266724), that of 2.5 to 10% Sn, 25 to 35% Bi, the balance In (Japanese Patent Application Laying-Open No. 2001-291459), and that of 1 to 15% Sn, 20 to 33% Bi, and the balance In (Japanese Patent Application Laying-Open No. 2001-325867).

When the liquidus phase diagram of a ternary Bi—In—Sn alloy is obtained, there are a binary eutectic point of 52In-48Sn and a ternary eutectic point of 21Sn-48In-31Bi, and the binary eutectic curve which elongates from the binary eutectic point toward the ternary eutectic point passes approximately through a frame of 24 to 47 Sn, 50 to 47 In, and 0 to 28 Bi.

As well known, when a heat energy is applied to an alloy at a constant rate, the heat energy is spent only in raising the temperature of the alloy as far as the solidus or liquidus state is maintained. When the alloy starts to melt, however, the temperature is raised while part of the energy is spent in the phase change. When the liquidification is then completed, the heat energy is spent only in temperature rise while the phase state is unchanged. The temperature rise/heat energy state can be obtained by a differential scanning calorimetry analysis [in which a reference specimen (unchanged) and a measurement specimen are housed in an $N_2$ gas-filled vessel, an electric power is supplied to a heater of the vessel to heat the samples at a constant rate, and a variation of the heat energy input amount due to a state change of the measurement specimen is detected by a differential thermocouple, and which is called a DSC].

Results of the DSC measurement are varied depending on the alloy composition. The inventor measured and eagerly studied DSCs of Bi—In—Sn alloys of various compositions, and unexpectedly found the following phenomenon. When an alloy composition in a specific region which is separated from the binary eutectic curve is used as fuse elements, the fuse elements can be concentrically fused off in the vicinity of the maximum endothermic peak, and excellent overload characteristic and dielectric breakdown characteristic are obtained.

By contrast, also the followings were known. In the case where a composition which is along or in the vicinity of the binary eutectic curve is used as fuse elements, even when the fuse elements can be concentrically fused off at concentrated temperatures by the usual technique, satisfactory overload characteristic and dielectric breakdown characteristic are hardly obtained.

The overload characteristic means external stability in which, even when a thermal fuse operates in an raised ambient temperature under the state where a current and a voltage of a specified degree are applied to the thermal fuse, the fuse is not damaged or does not generate an arc, a flame, or the like, thereby preventing a dangerous condition from occurring. The dielectric breakdown characteristic means insulation stability in which, even at a specified high voltage, a thermal fuse that has operated does not cause dielectric breakdown and the insulation can be maintained.

A method of evaluating the overload characteristic and the dielectric breakdown characteristic is specified in IEC (International Electrotechnical Commission) Standard 60691 which is a typical standard, as follows. When, while a rated voltage×1.1 and a rated current×1.5 are applied to a thermal fuse, the temperature is raised at a rate of 2±1 K/min, to cause the thermal fuse to operate, the fuse does not generate an arc, a flame, or the like, thereby preventing a dangerous condition from occurring. After the thermal fuse operates, even when a voltage of the rated voltage×2+1,000 V is applied for 1 min. between a metal foil wrapped around the body of the fuse and lead conductors, and, even when a voltage of the rated voltage×2 is applied for 1 min. between the lead conductors, discharge or dielectric breakdown does not occur.

SUMMARY OF THE INVENTION

It is an object of the invention to, based on the finding, provide an alloy type thermal fuse in which a fuse element of a Bi—In—Sn alloy is used, and which has excellent overload characteristic and dielectric breakdown characteristic.

It is a further object of the invention to lower the specific resistance of a fuse element and thin the fuse element, thereby enabling an alloy type thermal fuse to be thinned and miniaturized.

The material for a thermal fuse element of a first aspect of the invention has an alloy composition in which Sn is larger than 25% and 44% or smaller, Bi is 1% or larger and smaller than 20%, and In is larger than 55% and 74% or smaller.

In the material for a thermal fuse element of a second aspect of the invention, 0.1 to 3.5 weight parts of one, or two or more elements selected from the group consisting of Ag, Au, Cu, Ni, Pd, Pt, Sb, Ga, and Ge are added to 100 weight parts of the alloy composition of the first aspect of the invention.

The materials for a thermal fuse element are allowed to contain inevitable impurities which are produced in productions of metals of raw materials and also in melting and stirring of the raw materials, and which exist in an amount that does not substantially affect the characteristics. In the alloy type thermal fuses, a minute amount of a metal material or a metal film material of the lead conductors or the film electrodes is caused to inevitably migrate into the fuse element by solid phase diffusion, and, when the characteristics are not substantially affected, allowed to exist as inevitable impurities.

In the alloy type thermal fuse of a third aspect of the invention, the material for a thermal fuse element of the first or second aspect of the invention is used as a fuse element.

The alloy type thermal fuse of a fourth aspect of the invention is characterized in that, in the alloy type thermal fuse of the third aspect of the invention, the fuse element contains inevitable impurities.

The alloy type thermal fuse of a fifth aspect of the invention is an alloy type thermal fuse in which, in the alloy type thermal fuse of the third or fourth aspect of the invention, the fuse element is connected between lead conductors, and at least a portion of each of the lead conductors which is bonded to the fuse element is covered with an Sn or Ag film.

The alloy type thermal fuse of a sixth aspect of the invention is an alloy type thermal fuse in which, in the alloy type thermal fuse of any one of the third to fifth aspects of the invention, lead conductors are bonded to ends of the fuse element, respectively, a flux is applied to the fuse element, the flux-applied fuse element is passed through a cylindrical case, gaps between ends of the cylindrical case and the lead conductors are sealingly closed, ends of the lead conductors have a disk-like shape, and ends of the fuse element are bonded to front faces of the disks.

The alloy type thermal fuse of a seventh aspect of the invention is an alloy type thermal fuse in which, in the alloy type thermal fuse of the third or fourth aspect of the invention, a pair of film electrodes are formed on a substrate by printing conductive paste containing metal particles and a binder, the fuse element is connected between the film electrodes, and the metal particles are made of a material selected from the group consisting of Ag, Ag—Pd, Ag—Pt, Au, Ni, and Cu.

The alloy type thermal fuse of an eighth aspect of the invention is an alloy type thermal fuse in which, in the alloy type thermal fuse of any one of the third to seventh aspects of the invention, a heating element for fusing off the fuse element is additionally disposed.

The alloy type thermal fuse of a ninth aspect of the invention is an alloy type thermal fuse in which, in the alloy type thermal fuse of any one of the third to fifth aspects of the invention, a pair of lead conductors are partly exposed from one face of an insulating plate to another face, the fuse element is connected to the lead conductor exposed portions, and the other face of the insulating plate is covered with an insulating material.

The alloy type thermal fuse of a tenth aspect of the invention is an alloy type thermal fuse in which, in the alloy type thermal fuse of any one of the third to fifth aspects of the invention, the fuse element connected between a pair of lead conductors is sandwiched between insulating films.

DETAILED DESCRIPTION OF THE PREFERRED EMBODIMENTS

In the invention, a fuse element of a circular wire or a flat wire is used. The outer diameter or the thickness is set to 100 to 800 μm, preferably, 300 to 600 μm.

The reason why, in the first aspect of the invention, the fuse element has an alloy composition of 25%<weight of Sn≦44%, 1%≦weight of Bi<20%, and 55%<weight of In≦74% is as follows. The overlap with the above-mentioned known alloy compositions can be eliminated. An alloy melting characteristic of the pattern in which, although separated from the binary eutectic curve from the binary eutectic point of 52In-48Sn toward the ternary eutectic point of 21Sn-48In-31Bi in the liquidus phase diagram of a ternary Bi—In—Sn alloy, a division operation of the fuse element can be concentrically performed in the vicinity of the maximum endothermic peak can be obtained.

In order to eliminate the overlap with the above-mentioned known Bi—In—Sn compositions of the conventional thermal fuse elements, the range in which Sn is 25% or smaller and In is 55% or smaller is excluded. The range in which Bi is smaller than 1%, Sn is larger than 44%, and In is smaller than 74% is excluded because of the following reasons. Although the solid-liquid coexisting region may be wide, no endothermic peak exists in melting in the range, or there are two or more endothermic peaks. Therefore, dispersion of the operating temperature is expedited, or a holding temperature (operating temperature−20° C.) which will be described later is hardly set to be equal to lower than the solidus temperature.

Figure 10:
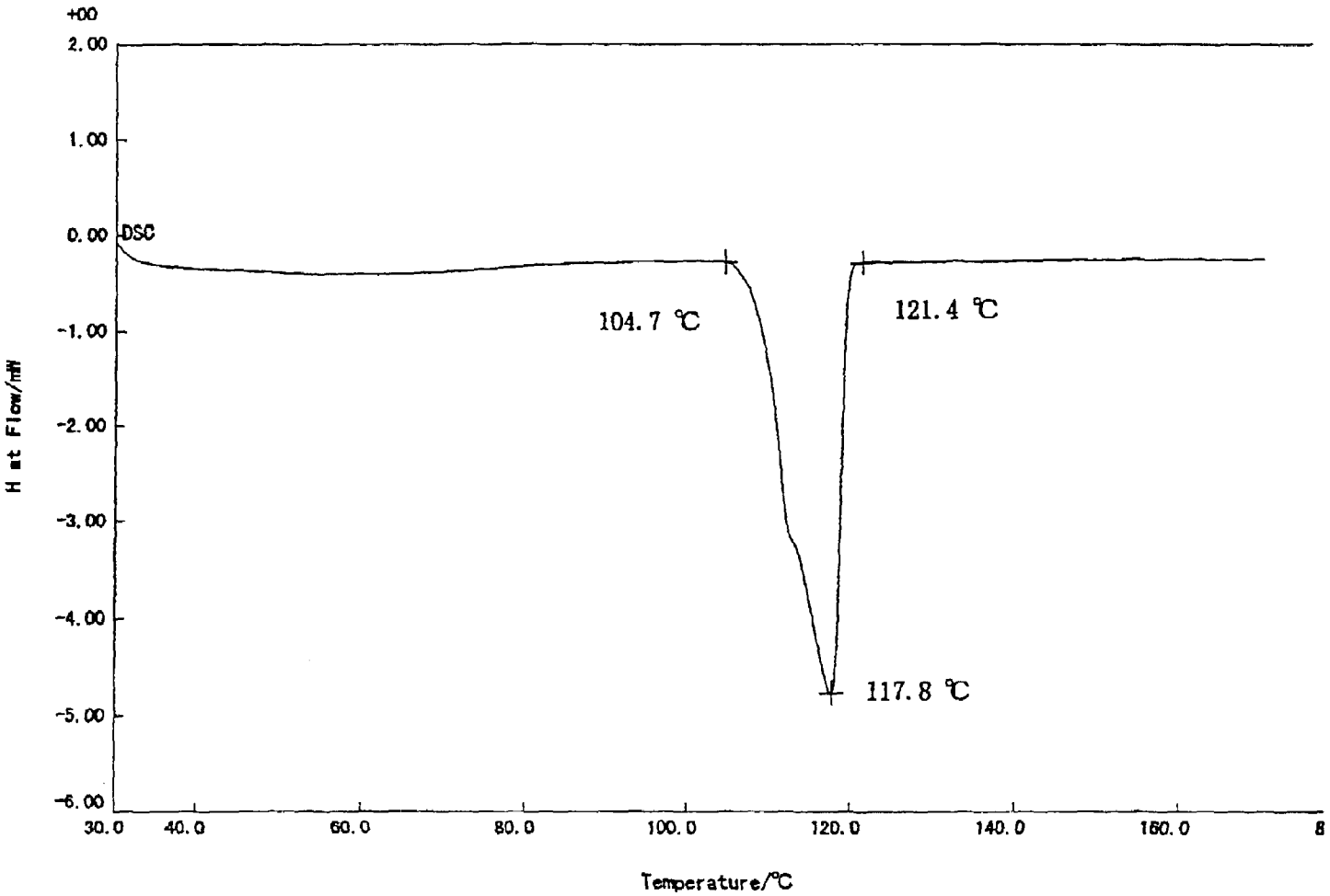
FIG. 10 is a view showing a DSC curve of a fuse element of Example 1.

The preferred range is 28%≦weight of Sn≦38%, 2%≦weight of Bi≦10%, and 60%≦weight of In≦70%. The reference composition is 30% Sn, 5% Bi, and 65% In. FIG. 10 shows a result of a DSC measurement at a temperature rise rate of 5° C./min. The liquidus temperature is about 121° C., and the solidus temperature is about 105° C. There is a single maximum endothermic peak at a temperature of about 118° C.

The fuse elements of the invention have the following performances.

(1) In the endothermic behavior in the melting process, a single maximum endothermic peak exists, and the heat absorption amount difference at the peak is very larger than the heat absorption amount difference in another portion of the endothermic process. The total amount of In and Sn which have a smaller surface tension is larger than the amount of Bi having a larger surface tension. Therefore, the wettability of the solid-liquid coexisting region at the maximum endothermic peak is sufficiently improved even before the completion of the liquidification, so that spheroid division of the thermal fuse element can be performed in the vicinity of the maximum endothermic peak.

(2) Therefore, dispersion of the operating temperature among thermal fuses can be set to be within an allowable range of ±5° C.

(3) When self-heating due to a passing current occurs in a fuse element, a thermal fuse operates at a lower environmental temperature than that in the case of no load. In a thermal fuse, therefore, it is required to set a maximum holding temperature at which, even when a rated current continues to flow for 168 hours, the fuse does not operate. The maximum holding temperature is called the holding temperature, and usually set to (operating temperature—20° C.). In this case, the solidus temperature is requested to be equal to or higher than the holding temperature. The fuse elements satisfy the requirement.

(4) Since In and Sn are contained in a relatively large amount, the fuse elements are provided with sufficient ductility required for drawing into a thin wire, so that drawing into a thin wire of 200 to 300 μmϕ is enabled.

(5) Excellent overload characteristic and dielectric breakdown characteristic can be assured. The melt pattern of the alloy composition shown in FIG. 10 exhibits a melting characteristic at a point which is separated from the binary eutectic curve by 15% or more in terms of the amount of In, and has a solid-liquid coexisting region as wide as 16° C. By contrast, in a fuse element of a composition in the vicinity of the binary eutectic curve, the solid-liquid coexisting region is narrow, and hence the alloy during energization and temperature rise is instantly changed from the solid phase to the liquid phase, thereby causing an arc to be easily generated during an operation. When an arc is generated, a local and sudden temperature rise occurs. As a result, the flux is vaporized to raise the internal pressure, or the flux is charred. In addition to the above, the molten alloy or the charred flux is intensely scattered as a result of a sudden energizing operation. Therefore, physical destruction such as crack generation due to a local and sudden internal pressure rise, or reconduction between charred flux portions easily occurs during an operation. Moreover, the insulation distance is shortened by the scattered alloy or the charred flux. Therefore, dielectric breakdown is easily caused by reconduction when a voltage is applied after an operation. By contrast, in a fuse element of the alloy composition of the invention, the alloy composition is considerably separated from the binary eutectic curve, and has a fairly wide solid-liquid coexisting region. The total content of In and Sn which have a smaller surface tension is larger than the content of Bi having a larger surface tension. Therefore, the fuse element is divided in a wide solid-liquid coexisting state even during energization and temperature rise, and hence the generation of an arc immediately after an operation can be satisfactorily suppressed. Because of a synergistic effect of the sufficient suppression of the arc generation immediately after an operation, and the reduced surface tension due to the small content of Bi, the above-mentioned physical destruction does not occur even in an overload test according to the nominal rating, so that the insulation resistance after an operation can be maintained to be sufficiently high and an excellent dielectric breakdown characteristic can be assured.

In the invention, 0.1 to 3.5 weight parts of one, or two or more elements selected from the group consisting of Ag, Au, Cu, Ni, Pd, Pt, Sb, Ga, and Ge are added to 100 weight parts of the alloy composition, in order to reduce the specific resistance of the alloy and improve the mechanical strength. When the addition amount is smaller than 0.1 weight parts, the effects cannot be sufficiently attained, and, when the addition amount is larger than 3.5 weight parts, the above-mentioned melting characteristic is hardly maintained.

With respect to a drawing process, further enhanced strength and ductility are provided so that drawing into a thin wire of 100 to 300 μmϕ can be easily conducted. In an alloy composition containing a large amount of In, the cohesive force is high. Even when a fuse element of such an alloy composition is not welded nor bonded to lead conductors or electrodes, therefore, a superficial appearance in which the element is bonded is produced as a result of the high cohesive force. The addition of the metal(s) reduces the cohesive force, so that this defect can be eliminated, and the accuracy of the acceptance criterion in a test after welding can be improved.

It is known that a to-be-bonded material such as a metal material of the lead conductors, a thin-film material, or a particulate metal material in the film electrode migrates into the fuse element by solid phase diffusion. When the same element as the to-be-bonded material, such as Ag, Au, Cu, or Ni is previously added to the fuse element, the migration can be suppressed. Therefore, an influence of the to-be-bonded material which may originally affect the characteristics (for example, Ag, Au, or the like causes local reduction or dispersion of the operating temperature due to the lowered melting point, and Cu, Ni, or the like causes dispersion of the operating temperature or an operation failure due to an increased intermetallic compound layer formed in the interface between different phases) is eliminated, and the thermal fuse can be assured to normally operate, without impairing the function of the fuse element.

The fuse element of the alloy type thermal fuse of the invention can be usually produced by a method in which a billet is produced, the billet is shaped into a stock wire by an extruder, and the stock wire is drawn by a dice to a wire. The outer diameter is 100 to 800 μmϕ, preferably, 300 to 600 μmϕ. The wire can be finally passed through calender rolls so as to be used as a flat wire.

Alternatively, the fuse element may be produced by the rotary drum spinning method in which a cylinder containing cooling liquid is rotated, the cooling liquid is held in a layer-like manner by a rotational centrifugal force, and a molten material jet ejected from a nozzle is introduced into the cooling liquid layer to be cooled and solidified, thereby obtaining a thin wire member.

In the production, the alloy composition is allowed to contain inevitable impurities which are produced in productions of metals of raw materials and also in melting and stirring of the raw materials.

The invention may be implemented in the form of a thermal fuse serving as an independent thermoprotector. Alternatively, the invention may be implemented in the form in which a thermal fuse element is connected in series to a semiconductor device, a capacitor, or a resistor, a flux is applied to the element, the flux-applied fuse element is placed in the vicinity of the semiconductor device, the capacitor, or the resistor, and the fuse element is sealed together with the semiconductor device, the capacitor, or the resistor by means of resin mold, a case, or the like.

Figure 1:
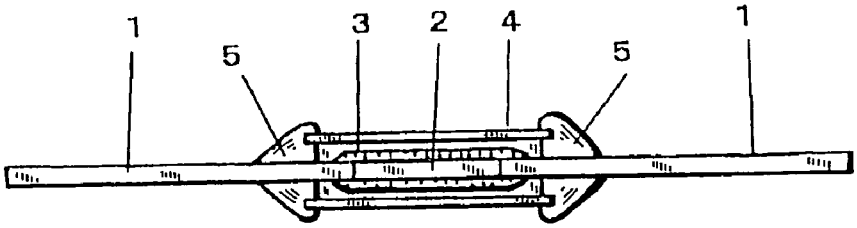
FIG. 1 is a view showing an example of the alloy type thermal fuse of the invention.

FIG. 1 shows an alloy type thermal fuse of the cylindrical case type according to the invention. A fuse element 2 made of a material for a thermal fuse element according to claim 1 or 2 is connected between a pair of lead conductors 1 by, for example, welding. A flux 3 is applied to the fuse element 2. The flux-applied fuse element is passed through an insulating tube 4 which is excellent in heat resistance and thermal conductivity, for example, a ceramic tube. Gaps between the ends of the insulating tube 4 and the lead conductors 1 are sealingly closed by a sealing agent 5 such as a cold-setting epoxy resin.

Figure 2:
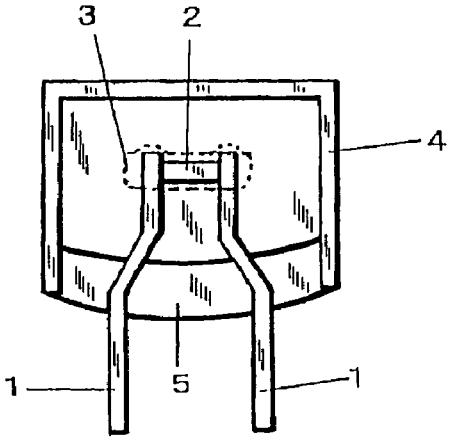
FIG. 2 is a view showing another example of the alloy type thermal fuse of the invention.

FIG. 2 shows a fuse of the radial case type. A fuse element 2 made of a material for a thermal fuse element according to claim 1 or 2 is connected between tip ends of parallel lead conductors 1 by, for example, welding. A flux 3 is applied to the fuse element 2. The flux-applied fuse element is enclosed by an insulating case 4 in which one end is opened, for example, a ceramic case. The opening of the insulating case 4 is sealingly closed by sealing agent 5 such as a cold-setting epoxy resin.

Figure 3:
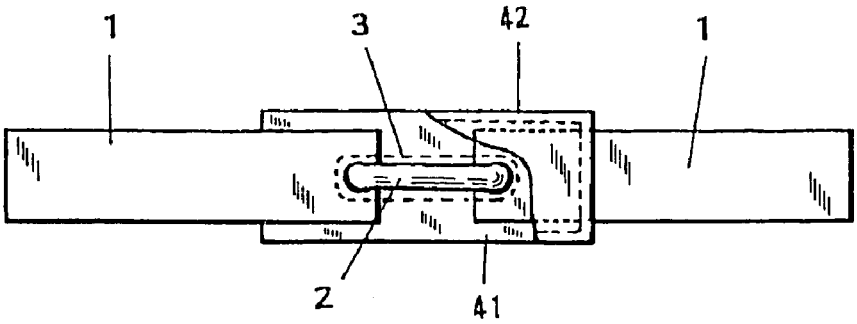
FIG. 3 is a view showing a further example of the alloy type thermal fuse of the invention.

FIG. 3 shows a thin type fuse. In the fuse, strip lead conductors 1 having a thickness of 100 to 200 μm are fixed by, for example, an adhesive agent or fusion bonding to a plastic base film 41 having a thickness of 100 to 300 μm. A fuse element 2 made of a material for a thermal fuse element according to claim 1 or 2 having a diameter of 250 to 500 μm is connected between the strip lead conductors by, for example, welding. A flux 3 is applied to the fuse element 2. The flux-applied fuse element is sealed by a plastic cover film 42 having a thickness of 100 to 300 μm by means of fixation using, for example, an adhesive agent or ultrasonic fusion bonding.

Figure 4:
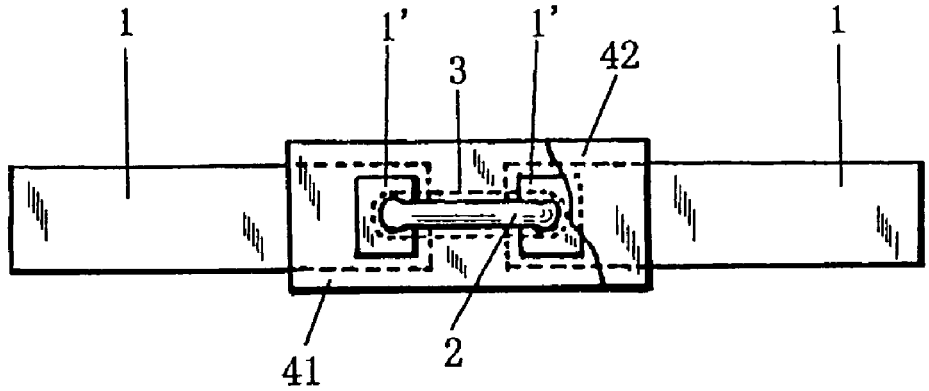
FIG. 4 is a view showing a still further example of the alloy type thermal fuse of the invention.

FIG. 4 shows another thin type fuse. In the fuse, strip lead conductors 1 having a thickness of 100 to 200 μm are fixed by, for example, an adhesive agent or fusion bonding to a plastic base film 41 having a thickness of 100 to 300 μm. Portions of the strip lead conductors are exposed to the side of the other face of the base film 41. A fuse element 2 made of a material for a thermal fuse element according to claim 1 or 2 having a diameter of 250 to 500 μmϕ is connected between the exposed portions of the strip lead conductors by, for example, welding. A flux 3 is applied to the fuse element 2. The flux-applied fuse element is sealed by a plastic cover film 42 having a thickness of 100 to 300 μm by means of fixation using, for example, an adhesive agent or ultrasonic fusion bonding.

Figure 5:
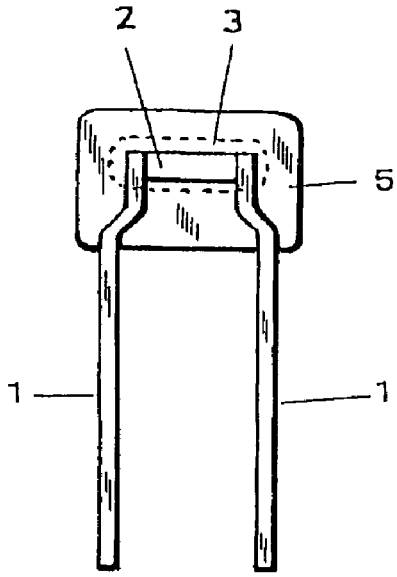
FIG. 5 is a view showing a still further example of the alloy type thermal fuse of the invention.

FIG. 5 shows a fuse of the radial resin dipping type. A fuse element 2 made of a material for a thermal fuse element according to claim 1 or 2 is bonded between tip ends of parallel lead conductors 1 by, for example, welding. A flux 3 is applied to the fuse element 2. The flux-applied fuse element is dipped into a resin solution to seal the element by an insulative sealing agent such as an epoxy resin 5.

Figure 6:
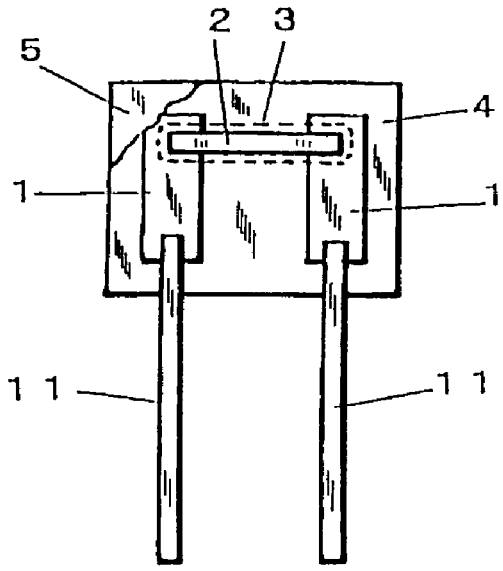
FIG. 6 is a view showing a still further example of the alloy type thermal fuse of the invention.

FIG. 6 shows a fuse of the substrate type. A pair of film electrodes 1 are formed on an insulating substrate 4 such as a ceramic substrate by printing conductive paste. Lead conductors 11 are connected respectively to the electrodes 1 by, for example, welding or soldering. A fuse element 2 made of a material for a thermal fuse element according to claim 1 or 2 is bonded between the electrodes 1 by, for example, welding. A flux 3 is applied to the fuse element 2. The flux-applied fuse element is covered with a sealing agent 5 such as an epoxy resin. The conductive paste contains metal particles and a binder. For example, Ag, Ag—Pd, Ag—Pt, Au, Ni, or Cu may be used as the metal particles, and a material containing a glass frit, a thermosetting resin, and the like may be used as the binder.

In the alloy type thermal fuses, in the case where Joule's heat of the fuse element is negligible, the temperature Tx of the fuse element when the temperature of the appliance to be protected reaches the allowable temperature Tm is lower than Tm by 2 to 3° C., and the melting point of the fuse element is usually set to [Tm—(2 to 3° C.)].

Figure 7:
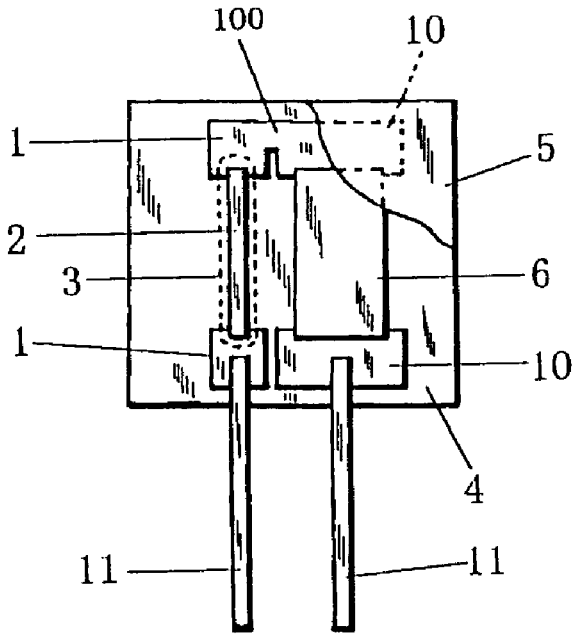
FIG. 7 is a view showing a still further example of the alloy type thermal fuse of the invention.

The invention may be implemented in the form in which a heating element for fusing off the fuse element is additionally disposed on the alloy type thermal fuse. As shown in FIG. 7, for example, a conductor pattern 100 having fuse element electrodes 1 and resistor electrodes 10 is formed on the insulating substrate 4 such as a ceramic substrate by printing conductive paste, and a film resistor 6 is disposed between the resistor electrodes 10 by applying and baking resistance paste (e.g., paste of metal oxide powder such as ruthenium oxide). A fuse element 2 of claim 1 or 2 is bonded between the fuse element electrodes 1 by, for example, welding. A flux 3 is applied to the fuse element 2. The flux-applied fuse element 2 and the film resistor 6 are covered with a sealing agent 5 such as an epoxy resin.

In the fuse having an electric heating element, a precursor causing abnormal heat generation of an appliance is detected, the film resistor is energized to generate heat in response to a signal indicative of the detection, and the fuse element is fused off by the heat generation.

The heating element may be disposed on the upper face of an insulating substrate. A heat-resistant and thermal-conductive insulating film such as a glass baked film is formed on the heating element. A pair of electrodes are disposed, flat lead conductors are connected respectively to the electrodes, and the fuse element is connected between the electrodes. A flux covers a range over the fuse element and the tip ends of the lead conductors. An insulating cover is placed on the insulating substrate, and the periphery of the insulating cover is sealingly bonded to the insulating substrate by an adhesive agent.

Among the alloy type thermal fuses, those of the type in which the fuse element is directly bonded to the lead conductors (FIGS. 1 to 5) may be configured in the following manner. At least portions of the lead conductors where the fuse element is bonded are covered with a thin film of Sn or Ag (having a thickness of, for example, 15 μm or smaller, preferably, 5 to 10 μm) (by plating or the like), thereby enhancing the bonding strength with respect to the fuse element.

In the alloy type thermal fuses, there is a possibility that a metal material or a thin film material in the lead conductors, or a particulate metal material in the film electrode migrates into the fuse element by solid phase diffusion. As described above, however, the characteristics of the fuse element can be sufficiently maintained by previously adding the same element as the thin film material into the fuse element.

As the flux, a flux having a melting point which is lower than that of the fuse element is generally used. For example, useful is a flux containing 90 to 60 weight parts of rosin, 10 to 40 weight parts of stearic acid, and 0 to 3 weight parts of an activating agent. In this case, as the rosin, a natural rosin, a modified rosin (for example, a hydrogenated rosin, an inhomogeneous rosin, or a polymerized rosin), or a purified rosin thereof can be used. As the activating agent, hydrochloride or hydrobromide of an amine such as diethylamine, or an organic acid such as adipic acid can be used.

Figure 8:
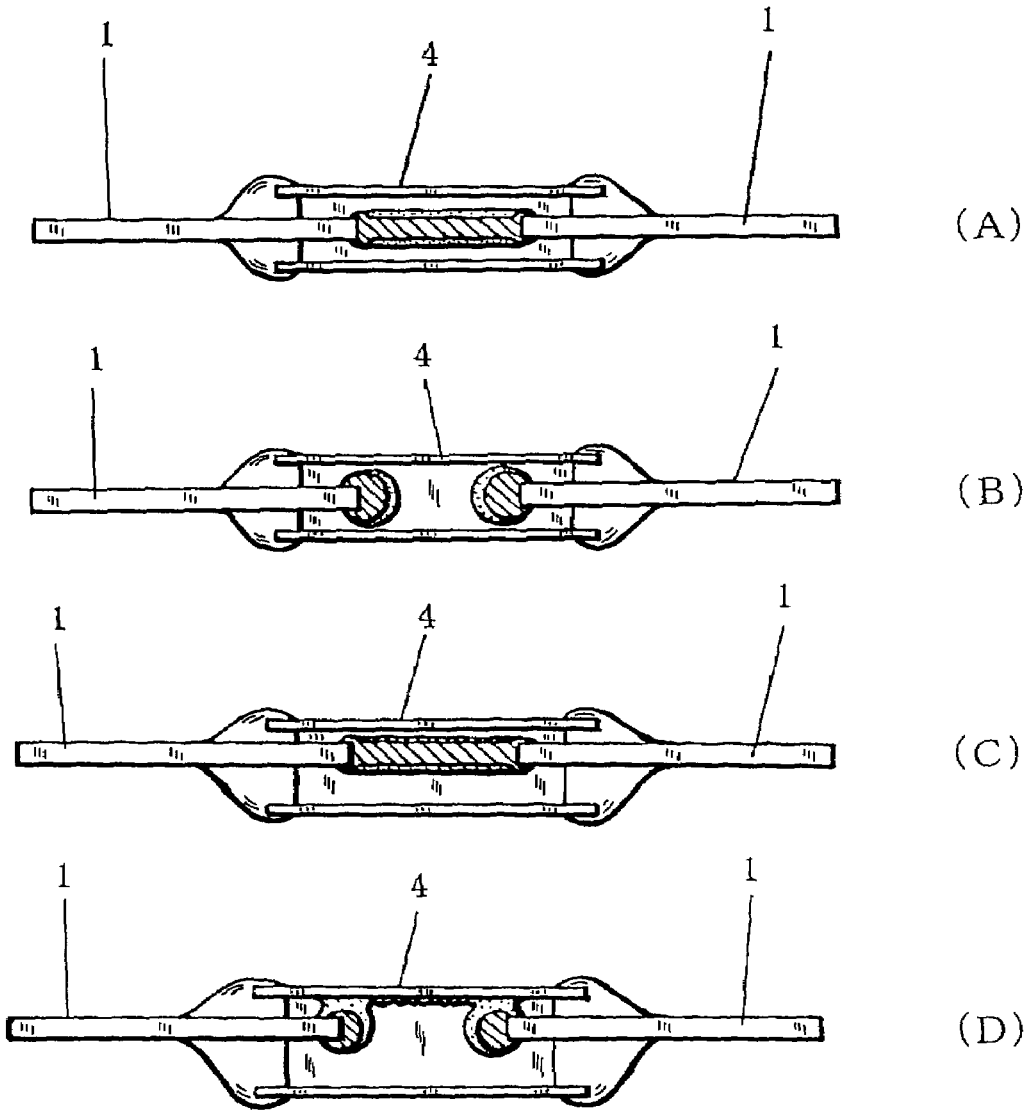
FIG. 8 is a view showing an alloy type thermal fuse of the cylindrical case type and its operation state.

Among the above-described alloy type thermal fuses, in the fuse of the cylindrical case type, the arrangement in which the lead conductors 1 are placed so as not to be eccentric to the cylindrical case 4 as shown in (A) of FIG. 8 is a precondition to enable the normal spheroid division shown in (B) of FIG. 8. When the lead conductors are eccentric as shown in (C) of FIG. 8, the flux (including a charred flux) and scattered alloy portions easily adhere to the inner wall of the cylindrical case after an operation as shown in (D) of FIG. 8. As a result, the insulation resistance is lowered, and the dielectric breakdown characteristic is impaired.

Figure 9:
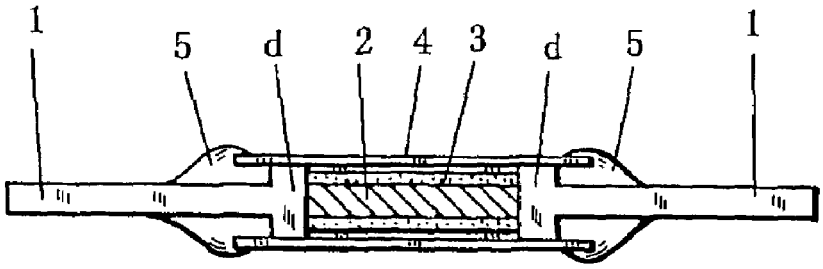
FIG. 9 is a view showing a still further example of the alloy type thermal fuse of the invention.
Figure 9:
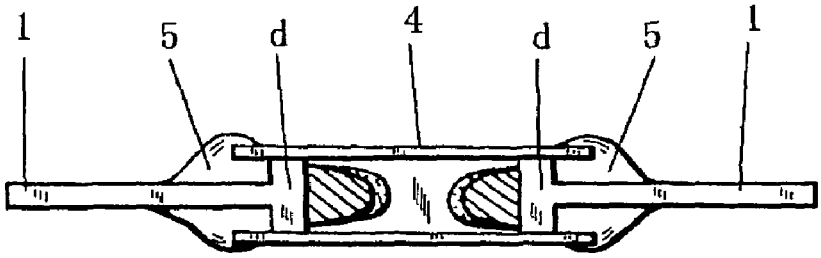

In order to prevent such disadvantages from being produced, as shown in (A) of FIG. 9, a configuration is effective in which ends of the lead conductors 1 are formed into a disk-like shape d, and ends of the fuse element 2 are bonded to the front faces of the disks d, respectively (by, for example, welding). The outer peripheries of the disks are supported by the inner face of the cylindrical case, and the fuse element 2 is positioned so as to be substantially concentrical with the cylindrical case 4 [in (A) of FIG. 9, 3 denotes a flux applied to the fuse element 2, 4 denotes the cylindrical case, 5 denotes a sealing agent such as an epoxy resin, and the outer diameter of each disk is approximately equal to the inner diameter of the cylindrical case]. In this instance, as shown in (B) of FIG. 9, molten portions of the fuse element spherically aggregate on the front faces of the disks d, thereby preventing the flux (including a charred flux) from adhering to the inner face of the case 4.

EXAMPLES

In the following examples and comparative examples, alloy type thermal fuses of the cylindrical case type having an AC rating of 3 A×250 V were used. The fuses have the following dimensions. The outer diameter of a cylindrical ceramic case is 2.5 mm, the thickness of the case is 0.5 mm, the length of the case is 9 mm, a lead conductor is an Sn plated annealed copper wire of an outer diameter of 0.6 mmϕ, and the outer diameter and length of a fuse element are 0.6 mmϕ and 3.5 mm, respectively. A compound of 80 weight parts of natural rosin, 20 weight parts of stearic acid, and 1 weight part of hydrobromide of diethylamine was used as the flux. A cold-setting epoxy resin was used as a sealing agent.

The solidus and liquidus temperatures of a fuse element were measured by a DSC at a temperature rise rate of 5° C./min.

Fifty specimens were used. Each of the specimens was immersed into an oil bath in which the temperature was raised at a rate of 1° C./min., while supplying a detection current of 0.1 A to the specimen, and the temperature T0 of the oil when the current supply was interrupted by blowing-out of the fuse element was measured. A temperature of T0—2° C. was determined as the operating temperature of the thermal fuse element.

The overload characteristic, and the insulation stability after an operation of a thermal fuse were evaluated on the basis of the overload test method and the dielectric breakdown test method defined in IEC 60691 (the humidity test before the overload test was omitted).

Specifically, existence of destruction or physical damage at an operation was checked. While a voltage of 1.1× the rated voltage and a current of 1.5× the rated current were applied to a specimen, and the thermal fuse was caused to operate by raising the environmental temperature at a rate of (2±1) K/min. Among specimens in which destruction or damage did not occur, those in which the insulation between lead conductors withstood 2× the rated voltage (500 V) for 1 min., and that between the lead conductors and a metal foil wrapped around the fuse body after an operation withstood 2× the rated voltage+1,000 V (1,500 V) for 1 min. were judged acceptable with respect to the dielectric breakdown characteristic, and those in which the insulation resistance between the lead conductors when a DC voltage of 2× the rated voltage (500 V) was applied was 0.2 MΩ or higher, and that between the lead conductors and the metal foil wrapped around the fuse body after an operation was 2 MΩ or higher were judged acceptable with respect to the insulation resistance. Acceptance with respect to both the dielectric breakdown characteristic and the insulation characteristic was set as the acceptance criterion for the insulation stability. When 50 specimens were used and all of the 50 specimens were accepted with respect to the insulation stability, the specimens were evaluated as ○, and, when even one of the specimens was not accepted, the specimens were evaluated as x.

Example 1

A composition of 30% Sn, 5% Bi, and the balance In was used as that of a fuse element. A fuse element was produced by a process of drawing to 300 μmϕ under the conditions of an area reduction per dice of 6.5%, and a drawing speed of 50 m/min. As a result, excellent workability was attained while no breakage occurred and no constricted portion was formed.

FIG. 10 shows a result of the DSC measurement. The liquidus temperature was about 121° C., the solidus temperature was about 105° C., and the maximum endothermic peak temperature was about 118° C.

The fuse element temperature at an operation of a thermal fuse was 118±2° C. Therefore, it is apparent that the fuse element temperature at an operation of a thermal fuse approximately coincides with the maximum endothermic peak temperature.

Even when the overload test was conducted, the fuse element was able to operate without involving any physical damage such as destruction. With respect to the dielectric breakdown test after the operation, the insulation between lead conductors withstood 2× the rated voltage (500 V) for 1 min. or longer, and that between the lead conductors and a metal foil wrapped around the fuse body after the operation withstood 2× the rated voltage+1,000 V (1,500 V) for 1 min. or longer. Therefore, the fuse element was acceptable. With respect to the insulation characteristic, the insulation resistance between the lead conductors when a DC voltage of 2× the rated voltage (500 V) was applied was 0.2 MΩ or higher, and that between the lead conductors and the metal foil wrapped around the fuse body after an operation was 2 MΩ or higher. Both the resistances were acceptable, and hence the insulation stability was evaluated as ○.

The reason why the overload characteristic and the insulation stability after an operation which are excellent as described above is as follows. Even during the energization and temperature rise, the division of the fuse element is performed in the wide solid-liquid coexisting region. Therefore, the occurrence of an arc immediately after an operation is sufficiently suppressed, and sudden temperature rise hardly occurs. Consequently, pressure rise by vaporization of the flux and charring of the flux due to the temperature rise can be suppressed, and physical destruction does not occur, and scattering and the like of molten alloy or charred flux due to an energizing operation can be satisfactorily suppressed, whereby a sufficient insulation distance can be ensured.

Examples 2 to 4

The examples were conducted in the same manner as Example 1 except that the alloy composition in Example 1 was changed as listed in Table 1.

The solidus and liquidus temperatures of the examples are shown in Table 1. The fuse element temperatures at an operation are as shown in Table 1, have dispersion of ±3° C. or smaller, and are in the solid-liquid coexisting region.

In the same manner as Example 1, both the overload characteristic and the insulation stability are acceptable. The reason of this is estimated as follows. In the same manner as Example 1, the fuse element is divided in a wide solid-liquid coexisting region.

In all the examples, good wire drawability was obtained in the same manner as Example 1.

TABLE 1

| | Ex. 2 | Ex. 3 | Ex. 4 |
|---|---|---|---|
| Sn (%) | 26 | 35 | 39 |
| Bi (%) | 5 | 5 | 5 |
| In | Balance | Balance | Balance |
| Solidus temperature (° C.) | 108 | 102 | 100 |
| Liquidus temperature (° C.) | 126 | 119 | 118 |
| Wire drawability | Good | Good | Good |
| Element temperature at operation (° C.) | 120 ± 3 | 111 ± 3 | 109 ± 2 |
| Overload characteristic | Damage, etc. are not observed | Damage, etc. are not observed | Damage, etc. are not observed |
| Insulation stability | ○ | ○ | ○ |

Examples 5 to 9

The examples were conducted in the same manner as Example 1 except that the alloy composition in Example 1 was changed as listed in Table 2.

The solidus and liquidus temperatures of the examples are shown in Table 2. The fuse element temperatures at an operation are as shown in Table 2, have dispersion of ±2° C. or smaller, and are in the solid-liquid coexisting region.

In the same manner as Example 1, both the overload characteristic and the insulation stability are acceptable. The reason of this is estimated as follows. In the same manner as Example 1, the fuse element is divided in a wide solid-liquid coexisting region.

In all the examples, good wire drawability was obtained in the same manner as Example 1.

TABLE 2

| | Ex. 5 | Ex. 6 | Ex. 7 | Ex. 8 | Ex. 9 |
|---|---|---|---|---|---|
| Sn (%) | 26 | 30 | 35 | 40 | 43 |
| Bi (%) | 1 | 1 | 1 | 1 | 1 |
| In | Balance | Balance | Balance | Balance | Balance |
| Solidus temperature (° C.) | 124 | 121 | 119 | 119 | 118 |
| Liquidus temperature (° C.) | 134 | 132 | 130 | 126 | 125 |
| Wire drawability | Good | Good | Good | Good | Good |
| Element temperature at operation (° C.) | 128 ± 2 | 125 ± 2 | 122 ± 2 | 120 ± 1 | 119 ± 1 |
| Overload characteristic | Damage, etc. are not observed | Damage, etc. are not observed | Damage, etc. are not observed | Damage, etc. are not observed | Damage, etc. are not observed |
| Insulation stability | ○ | ○ | ○ | ○ | ○ |

Examples 10 to 12

The examples were conducted in the same manner as Example 1 except that the alloy composition in Example 1 was changed as listed in Table 3.

The solidus and liquidus temperatures of the examples are shown in Table 3. The fuse element temperatures at an operation are as shown in Table 3, have dispersion of ±1° C. or smaller, and are in the solid-liquid coexisting region.

In the same manner as Example 1, both the overload characteristic and the insulation stability are acceptable. The reason of this is estimated as follows. In the same manner as Example 1, the fuse element is divided in a wide solid-liquid coexisting region.

In all the examples, good wire drawability was obtained in the same manner as Example 1.

TABLE 3

| | Ex. 10 | Ex. 11 | Ex. 12 |
|---|---|---|---|
| Sn (%) | 26 | 29 | 26 |
| Bi (%) | 15 | 15 | 18 |
| In | Balance | Balance | Balance |
| Solidus temperature (° C.) | 60 | 60 | 61 |
| Liquidus temperature (° C.) | 101 | 103 | 90 |
| Wire drawability | Good | Good | Good |
| Element temperature at operation (° C.) | 61 ± 1 | 62 ± 1 | 62 ± 1 |
| Overload characteristic | Damage, etc. are not observed | Damage, etc. are not observed | Damage, etc. are not observed |
| Insulation stability | ○ | ○ | ○ |

Example 13

The example was conducted in the same manner as Example 1 except that an alloy composition in which 1 weight part of Ag was added to 100 weight parts of the alloy composition of Example 1 was used as that of a fuse element.

A wire member for a fuse element of 300 μmϕ was produced under conditions in which the area reduction per dice was 8% and the drawing speed was 80 m/min., and which are severer than those of the drawing process of a wire member for a fuse element in Example 1. However, no wire breakage occurred, and problems such as a constricted portion were not caused, with the result that the example exhibited excellent workability.

The solidus temperature was 103° C., and the maximum endothermic peak temperature and the fuse element temperature at an operation of a thermal fuse were lowered only by about 2° C. as compared with those in Example 1. Namely, it was confirmed that the operating temperature and the melting characteristic can be held without being largely differentiated from those of Example 1.

In the same manner as Example 1, even when the overload test was conducted, the fuse element was able to operate without involving any physical damage such as destruction. Therefore, the fuse element was acceptable. With respect to the dielectric breakdown test after the operation, the insulation between lead conductors withstood 2× the rated voltage (500 V) for 1 min. or longer, and that between the lead conductors and a metal foil wrapped around the fuse body after the operation withstood 2× the rated voltage+1,000 V (1,500 V) for 1 min. or longer. Therefore, the fuse element was acceptable. With respect to the insulation characteristic, the insulation resistance between the lead conductors when a DC voltage of 2× the rated voltage (500 V) was applied was 0.2 MΩ or higher, and that between the lead conductors and the metal foil wrapped around the fuse body after an operation was 2 MΩ or higher. Both the resistances were acceptable, and hence the insulation stability was evaluated as ○. Therefore, it was confirmed that, in spite of addition of Ag, the good overload characteristic and insulation stability can be held.

It was confirmed that the above-mentioned effects are obtained in the range of the addition amount of 0.1 to 3.5 weight parts of Ag.

In the case where the metal material of the lead conductors to be bonded, a thin film material, or a particulate metal material in the film electrode is Ag, it was confirmed that, when the same element or Ag is previously added as in the example, the metal material can be prevented from, after a fuse element is bonded, migrating into the fuse element with time by solid phase diffusion, and local reduction or dispersion of the operating temperature due to the lowered melting point can be eliminated.

Examples 14 to 21

The examples were conducted in the same manner as Example 1 except that an alloy composition in which 0.5 weight parts of respective one of Au, Cu, Ni, Pd, Pt, Ga, Ge, and Sb were added to 100 weight parts of the alloy composition of Example 1 was used as that of a fuse element.

It was confirmed that, in the same manner as the metal addition of Ag in Example 13, also the addition of Au, Cu, Ni, Pd, Pt, Ga, Ge, or Sb realizes excellent workability, the operating temperature and melting characteristic of Example 1 can be sufficiently ensured, the good overload characteristic and insulation stability can be held, and solid phase diffusion between metal materials of the same kind can be suppressed.

It was confirmed that the above-mentioned effects are obtained in the range of the addition amount of 0.1 to 3.5 weight parts of respective one of Au, Cu, Ni, Pd, Pt, Ga, Ge, and Sb.

Comparative Example 1

The comparative example was conducted in the same manner as Example 1 except that the composition of the fuse element in Example 1 was changed to 25% Sn, 22% Bi, and the balance In.

The workability was satisfactory. Since the solid-liquid coexisting region is relatively narrow, dispersion of the operating temperature was within the allowable range.

In the overload test, the fuse element operated without causing physical damage such as destruction. Therefore, the comparative example was acceptable.

In the dielectric breakdown test after an operation, however, the insulation resistance between lead conductors was as low as 0.1 MΩ or lower. When a voltage of 2× the rated voltage (500 V) was applied, reconduction often occurred. Therefore, the insulation stability was x.

The reason of this is estimated as follows. Although the fuse element is broken in the solid-liquid coexisting region, the region is relatively narrow, and hence the alloy during energization and temperature rise is rapidly changed from the solid phase to the liquid phase, thereby causing an arc to be generated immediately after an operation. As a result, the flux is easily charred by a local and sudden temperature rise. Therefore, the insulation distance is shortened during an operation by the scattered alloy or the charred flux, and hence the insulation resistance is low. As a result, when a voltage is applied, reconduction occurs to cause dielectric breakdown.

Comparative Example 2

The comparative example was conducted in the same manner as Example 1 except that the composition of the fuse element in Example 1 was changed to 65% Sn and the balance In.

The workability was satisfactory, and dispersion of the operating temperature was small, thereby causing no problem. In the overload test, the fuse element operated without causing physical damage such as destruction. Therefore, the comparative example was acceptable.

In the dielectric breakdown test after an operation, however, the insulation resistance between lead conductors was as low as 0.1 MΩ or lower. When a voltage of 2× the rated voltage (500 V) was applied, reconduction often occurred. Therefore, the insulation stability was x.

The reason of this is estimated as follows. In the same manner as Comparative example 1, although the fuse element is broken in the solid-liquid coexisting region, the region is relatively narrow, and hence the alloy during energization and temperature rise is rapidly changed from the solid phase to the liquid phase, thereby causing an arc to be generated immediately after an operation. As a result, the flux is charred by a local and sudden temperature rise. Therefore, the insulation distance is shortened during an operation by the scattered alloy or the charred flux, and hence the insulation resistance is low. As a result, when a voltage is applied, reconduction occurs to cause dielectric breakdown.

Comparative Example 3

The comparative example was conducted in the same manner as Example 1 except that the composition of the fuse element in Example 1 was changed to 20% Sn, 10% Bi, and the balance In.

The workability was satisfactory. Since the solid-liquid coexisting region is relatively narrow, dispersion of the operating temperature (110±3° C.) was within the allowable range. In the overload test, the fuse element operated without causing physical damage such as destruction. Therefore, the comparative example was acceptable.

However, the solidus temperature is 67° C. or lower than (operating temperature—20° C.), and hence fails to satisfy the requirement of the holding temperature.

Comparative Example 4

The comparative example was conducted in the same manner as Example 1 except that the composition of the fuse element in Example 1 was changed to 45% Sn, 5% Bi, and the balance In.

The workability was satisfactory, and dispersion of the operating temperature was small, thereby causing no problem. In the overload test, the fuse element operated without causing physical damage such as destruction. Therefore, the comparative example was acceptable.

In the dielectric breakdown test after an operation, however, the insulation resistance between lead conductors was as low as 0.1 MΩ or lower. When a voltage of 2× the rated voltage (500 V) was applied, reconduction often occurred. Therefore, the insulation stability was x.

The reason of this is estimated as follows. In the same manner as Comparative example 1, although the fuse element is broken in the solid-liquid coexisting region, the region is relatively narrow, and hence the alloy during energization and temperature rise is rapidly changed from the solid phase to the liquid phase, thereby causing an arc to be generated immediately after an operation. As a result, the flux is charred by a local and sudden temperature rise. Therefore, the insulation distance is shortened during an operation by the scattered alloy or the charred flux, and hence the insulation resistance is low. As a result, when a voltage is applied, reconduction occurs to cause dielectric breakdown.

Comparative Example 5

The comparative example was conducted in the same manner as Example 1 except that the composition of the fuse element in Example 1 was changed to 20% Sn, 15% Bi, and the balance In.

The workability was satisfactory. However, the operating temperature was dispersed over the range of about 150 to 165° C. or at a large degree. The solidus temperature is 64° C. This temperature is lower than (operating temperature—20° C.), and hence fails to satisfy the requirement of the holding temperature.

According to the material for a thermal fuse element and the thermal fuse of the invention, it is possible to provide an alloy type thermal fuse in which a Bi—In—Sn alloy that does not contain a heavy metal harmful to a living body is used, and which has excellent overload characteristic, dielectric breakdown characteristic after an operation, and insulation characteristic. According to the material for a thermal fuse element of the second aspect of the invention and the alloy type thermal fuse, since a fuse element can be easily thinned because of the excellent wire drawability of the material for a thermal fuse element, the thermal fuse can be advantageously miniaturized and thinned. Even in the case where an alloy type thermal fuse is configured by bonding a fuse element to a to-be-bonded material which may originally exert an influence, a normal operation can be assured without impairing the functions of the fuse element.

According to the alloy type thermal fuses of the third to tenth aspects of the invention, particularly, the above effects can be assured in a thermal fuse of the cylindrical case type, a thermal fuse of the substrate type, a thin thermal fuse of the tape type, a thermal fuse having an electric heating element, and a thermal fuse or a thermal fuse having an electric heating element in which lead conductors are plated by Ag or the like, whereby the usefulness of such a thermal fuse or a thermal fuse having an electric heating element can be enhanced.

What is claimed is:

1. A material for a thermal fuse element wherein said material has an alloy composition in which Sn is larger than 25% and 44% or smaller, Bi is 1% or larger and smaller than 20%, and In is larger than 55% and 74% or smaller.

2. A material for a thermal fuse element wherein 0.1 to 3.5 weight parts of one, or two or more elements selected from the group consisting of Ag, Au, Cu, Ni, Pd, Pt, Sb, Ga, and Ge are added to 100 weight parts of an alloy composition of claim 1.

3. An alloy type thermal fuse wherein a material for a thermal fuse element of claim 1 is used as a fuse element.

4. An alloy type thermal fuse wherein a material for a thermal fuse element of claim 2 is used as a fuse element.

5. An alloy type thermal fuse according to claim 3, wherein said fuse element contains inevitable impurities.

6. An alloy type thermal fuse according to claim 4, wherein said fuse element contains inevitable impurities.

7. An alloy type thermal fuse according to claim 3, wherein said fuse element is connected between lead conductors, and at least a portion of each of said lead conductors which is bonded to said fuse element is covered with an Sn or Ag film.

8. An alloy type thermal fuse according to claim 4, wherein said fuse element is connected between lead conductors, and at least a portion of each of said lead conductors which is bonded to said fuse element is covered with an Sn or Ag film.

9. An alloy type thermal fuse according to claim 5, wherein said fuse element is connected between lead conductors, and at least a portion of each of said lead conductors which is bonded to said fuse element is covered with an Sn or Ag film.

10. An alloy type thermal fuse according to claim 6, wherein said fuse element is connected between lead conductors, and at least a portion of each of said lead conductors which is bonded to said fuse element is covered with an Sn or Ag film.

11. An alloy type thermal fuse according to claim 3, wherein lead conductors are bonded to ends of said fuse element, respectively, a flux is applied to said fuse element, said flux-applied fuse element is passed through a cylindrical case, gaps between ends of said cylindrical case and said lead conductors are sealingly closed, ends of said lead conductors have a disk-like shape, and ends of said fuse element are bonded to front faces of said disks.

12. An alloy type thermal fuse according to claim 4, wherein lead conductors are bonded to ends of said fuse element, respectively, a flux is applied to said fuse element, said flux-applied fuse element is passed through a cylindrical case, gaps between ends of said cylindrical case and said lead conductors are sealingly closed, ends of said lead conductors have a disk-like shape, and ends of said fuse element are bonded to front faces of said disks.

13. An alloy type thermal fuse according to claim 5, wherein lead conductors are bonded to ends of said fuse element, respectively, a flux is applied to said fuse element, said flux-applied fuse element is passed through a cylindrical case, gaps between ends of said cylindrical case and said lead conductors are sealingly closed, ends of said lead conductors have a disk-like shape, and ends of said fuse element are bonded to front faces of said disks.

14. An alloy type thermal fuse according to claim 6, wherein lead conductors are bonded to ends of said fuse element, respectively, a flux is applied to said fuse element, said flux-applied fuse element is passed through a cylindrical case, gaps between ends of said cylindrical case and said lead conductors are sealingly closed, ends of said lead conductors have a disk-like shape, and ends of said fuse element are bonded to front faces of said disks.

15. An alloy type thermal fuse according to claim 7, wherein lead conductors are bonded to ends of said fuse element, respectively, a flux is applied to said fuse element, said flux-applied fuse element is passed through a cylindrical case, gaps between ends of said cylindrical case and said lead conductors are sealingly closed, ends of said lead conductors have a disk-like shape, and ends of said fuse element are bonded to front faces of said disks.

16. An alloy type thermal fuse according to claim 8, wherein lead conductors are bonded to ends of said fuse element, respectively, a flux is applied to said fuse element, said flux-applied fuse element is passed through a cylindrical case, gaps between ends of said cylindrical case and said lead conductors are sealingly closed, ends of said lead conductors have a disk-like shape, and ends of said fuse element are bonded to front faces of said disks.

17. An alloy type thermal fuse according to claim 9, wherein lead conductors are bonded to ends of said fuse element, respectively, a flux is applied to said fuse element, said flux-applied fuse element is passed through a cylindrical case, gaps between ends of said cylindrical case and said lead conductors are sealingly closed, ends of said lead conductors have a disk-like shape, and ends of said fuse element are bonded to front faces of said disks.

18. An alloy type thermal fuse according to claim 10, wherein lead conductors are bonded to ends of said fuse element, respectively, a flux is applied to said fuse element, said flux-applied fuse element is passed through a cylindrical case, gaps between ends of said cylindrical case and said lead conductors are sealingly closed, ends of said lead conductors have a disk-like shape, and ends of said fuse element are bonded to front faces of said disks.

19. An alloy type thermal fuse according to claim 3, wherein a pair of film electrodes are formed on a substrate by printing conductive paste containing metal particles and a binder, said fuse element is connected between said film electrodes, and said metal particles are made of a material selected from the group consisting of Ag, Ag—Pd, Ag—Pt, Au, Ni, and Cu.

20. An alloy type thermal fuse according to claim 4, wherein a pair of film electrodes are formed on a substrate by printing conductive paste containing metal particles and a binder, said fuse element is connected between said film electrodes, and said metal particles are made of a material selected from the group consisting of Ag, Ag—Pd, Ag—Pt, Au, Ni, and Cu.

21. An alloy type thermal fuse according to claim 5, wherein a pair of film electrodes are formed on a substrate by printing conductive paste containing metal particles and a binder, said fuse element is connected between said film electrodes, and said metal particles are made of a material selected from the group consisting of Ag, Ag—Pd, Ag—Pt, Au, Ni, and Cu.

22. An alloy type thermal fuse according to claim 6, wherein a pair of film electrodes are formed on a substrate by printing conductive paste containing metal particles and a binder, said fuse element is connected between said film electrodes, and said metal particles are made of a material selected from the group consisting of Ag, Ag—Pd, Ag—Pt, Au, Ni, and Cu.

23. An alloy type thermal fuse according to claim 3, wherein a heating element for fusing off said fuse element is additionally disposed.

24. An alloy type thermal fuse according to claim 4, wherein a heating element for fusing off said fuse element is additionally disposed.

25. An alloy type thermal fuse according to claim 5, wherein a heating element for fusing off said fuse element is additionally disposed.

26. An alloy type thermal fuse according to claim 6, wherein a heating element for fusing off said fuse element is additionally disposed.

27. An alloy type thermal fuse according to claim 7, wherein a heating element for fusing off said fuse element is additionally disposed.

28. An alloy type thermal fuse according to claim 8, wherein a heating element for fusing off said fuse element is additionally disposed.

29. An alloy type thermal fuse according to claim 9, wherein a heating element for fusing off said fuse element is additionally disposed.

30. An alloy type thermal fuse according to claim 10, wherein a heating element for fusing off said fuse element is additionally disposed.

31. An alloy type thermal fuse according to claim 11, wherein a heating element for fusing off said fuse element is additionally disposed.

32. An alloy type thermal fuse according to claim 12, wherein a heating element for fusing off said fuse element is additionally disposed.

33. An alloy type thermal fuse according to claim 13, wherein a heating element for fusing off said fuse element is additionally disposed.

34. An alloy type thermal fuse according to claim 14, wherein a heating element for fusing off said fuse element is additionally disposed.

35. An alloy type thermal fuse according to claim 15, wherein a heating element for fusing off said fuse element is additionally disposed.

36. An alloy type thermal fuse according to claim 16, wherein a heating element for fusing off said fuse element is additionally disposed.

37. An alloy type thermal fuse according to claim 17, wherein a heating element for fusing off said fuse element is additionally disposed.

38. An alloy type thermal fuse according to claim 18, wherein a heating element for fusing off said fuse element is additionally disposed.

39. An alloy type thermal fuse according to claim 19, wherein a heating element for fusing off said fuse element is additionally disposed.

40. An alloy type thermal fuse according to claim 20, wherein a heating element for fusing off said fuse element is additionally disposed.

41. An alloy type thermal fuse according to claim 21, wherein a heating element for fusing off said fuse element is additionally disposed.

42. An alloy type thermal fuse according to claim 22, wherein a heating element for fusing off said fuse element is additionally disposed.

43. An alloy type thermal fuse according to claim 3, wherein a pair of lead conductors are partly exposed from one face of an insulating plate to another face, said fuse element is connected to said lead conductor exposed portions, and said other face of said insulating plate is covered with an insulating material.

44. An alloy type thermal fuse according to claim 4, wherein a pair of lead conductors are partly exposed from one face of an insulating plate to another face, said fuse element is connected to said lead conductor exposed portions, and said other face of said insulating plate is covered with an insulating material.

45. An alloy type thermal fuse according to claim 5, wherein a pair of lead conductors are partly exposed from one face of an insulating plate to another face, said fuse element is connected to said lead conductor exposed portions, and said other face of said insulating plate is covered with an insulating material.

46. An alloy type thermal fuse according to claim 6, wherein a pair of lead conductors are partly exposed from one face of an insulating plate to another face, said fuse element is connected to said lead conductor exposed portions, and said other face of said insulating plate is covered with an insulating material.

47. An alloy type thermal fuse according to claim 7, wherein a pair of lead conductors are partly exposed from one face of an insulating plate to another face, said fuse element is connected to said lead conductor exposed portions, and said other face of said insulating plate is covered with an insulating material.

48. An alloy type thermal fuse according to claim 8, wherein a pair of lead conductors are partly exposed from one face of an insulating plate to another face, said fuse element is connected to said lead conductor exposed portions, and said other face of said insulating plate is covered with an insulating material.

49. An alloy type thermal fuse according to claim 9, wherein a pair of lead conductors are partly exposed from one face of an insulating plate to another face, said fuse element is connected to said lead conductor exposed portions, and said other face of said insulating plate is covered with an insulating material.

50. An alloy type thermal fuse according to claim 10, wherein a pair of lead conductors are partly exposed from one face of an insulating plate to another face, said fuse element is connected to said lead conductor exposed portions, and said other face of said insulating plate is covered with an insulating material.

51. An alloy type thermal fuse according to claim 3, wherein said fuse element connected between a pair of lead conductors is sandwiched between insulating films.

52. An alloy type thermal fuse according to claim 4, wherein said fuse element connected between a pair of lead conductors is sandwiched between insulating films.

53. An alloy type thermal fuse according to claim 5, wherein said fuse element connected between a pair of lead conductors is sandwiched between insulating films.

54. An alloy type thermal fuse according to claim 6, wherein said fuse element connected between a pair of lead conductors is sandwiched between insulating films.

55. An alloy type thermal fuse according to claim 7, wherein said fuse element connected between a pair of lead conductors is sandwiched between insulating films.

56. An alloy type thermal fuse according to claim 8, wherein said fuse element connected between a pair of lead conductors is sandwiched between insulating films.

57. An alloy type thermal fuse according to claim 9, wherein said fuse element connected between a pair of lead conductors is sandwiched between insulating films.

58. An alloy type thermal fuse according to claim 10, wherein said fuse element connected between a pair of lead conductors is sandwiched between insulating films.

* * * * *